United States Patent [19]

Reifenhauser

[11] Patent Number: 5,030,191

[45] Date of Patent: Jul. 9, 1991

[54] DEVICE FOR DEPOSITING AND STACKING BAGS PRODUCED FROM SYNTHETIC RESIN FILMS AND HAVING A BOTTOM SEAM

[76] Inventor: Hans Reifenhauser, Altenrather Str. 15, D-5210 Troisdorf, Fed. Rep. of Germany

[21] Appl. No.: 391,570

[22] PCT Filed: Feb. 10, 1988

[86] PCT No.: PCT/EP88/00098

§ 371 Date: Jul. 28, 1989

§ 102(e) Date: Jul. 28, 1989

[87] PCT Pub. No.: WO88/06091

PCT Pub. Date: Aug. 25, 1988

[30] Foreign Application Priority Data

Feb. 14, 1987 [DE] Fed. Rep. of Germany ..... 3704633

[51] Int. Cl.[5] ..... B31B 23/98; B31B 19/98; B65H 29/40

[52] U.S. Cl. ..... 493/204; 414/27; 414/790.4

[58] Field of Search ..... 493/204; 414/27, 790.4

[56] References Cited

U.S. PATENT DOCUMENTS

| | | | |
|---|---|---|---|
| 3,221,902 | 12/1965 | Young | 414/790.4 |
| 3,343,691 | 9/1967 | Anderson | 414/790.4 |
| 3,791,267 | 2/1974 | Brooks | 493/204 |
| 4,342,564 | 8/1982 | Lehmacher | 493/195 |
| 4,693,701 | 9/1987 | DeBin | 493/204 |

*Primary Examiner*—William E. Terrell

*Attorney, Agent, or Firm*—Antonelli, Terry, Stout & Kraus

[57] ABSTRACT

A device is provided with vertical holding elements for depositing and stacking of plastic bags having welded lower or bottom seams. The holding elements are fixed to crossbeams which extend across an advancing plane in the feeding direction of the bag and are hinged onto an outer circumference of a rotatable support. The support is in the form of an impeller wheel and the crossbeams are set on the support so that the holding elements maintain a vertical position as the crossbeams rotate.

14 Claims, 4 Drawing Sheets

Figure 1:
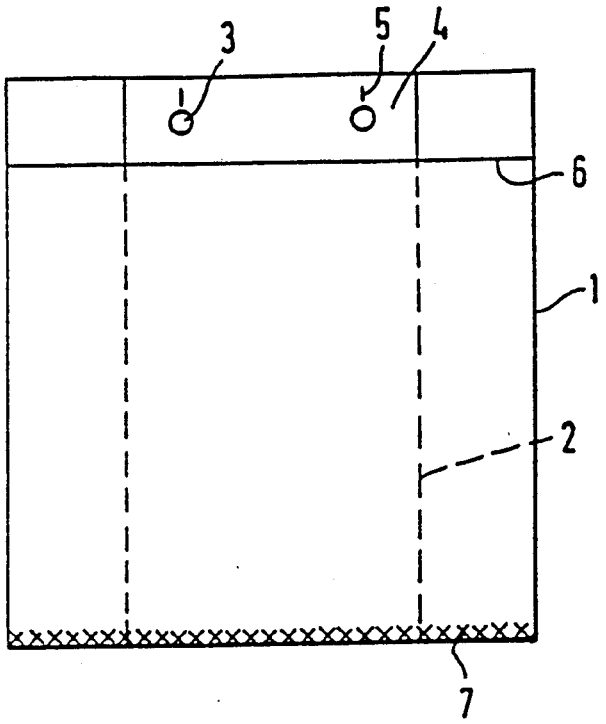

DEVICE FOR DEPOSITING AND STACKING BAGS PRODUCED FROM SYNTHETIC RESIN FILMS AND HAVING A BOTTOM SEAM

The invention relates to a device for depositing and stacking bags having a bottom seam and manufactured from a tubular film of a thermoplastic synthetic resin moved in increments in the feeding direction, by welding and cutting transversely to the feeding direction, with a welding and cutting unit operating in cycles for welding the bottom seam and severing the bags transversely to the feeding direction, and with a subsequently arranged stacking and conveying unit with crossbeams of strip shape attached to a movable support transversely to the feeding direction, these crossbeams being equipped with vertically upwardly oriented holding elements in the shape of pins, stacking tubes, or the like, the severed bags being deposited on these holding elements A device of this type has been known, for example, from DOS 2,305,800 wherein the holding elements for receiving the bags are mounted rigidly to belts rotating in sections in an endless fashion and are oriented upwardly in the vertical direction only in the receiving position for the bags. The bags are seized by the holding elements before the bags are cut off the tubular film. This device can be used for depositing the bags loosely into stacks; simultaneous interlocking of the bags into stacks at the depositing site cannot be performed.

Devices for the production of interlocked stacks of bags with bottom seam are known, for example, from DOS 2,254,448 and DOS 2,358,281 wherein a single, liftable and lowerable strip arranged transversely to the feeding direction and having vertically upwardly oriented holding elements is provided for the bags cut off from the tubular film, units for perforating and weld bonding being associated therewith. Similar devices for the manufacture of optionally interlocked stacks of bags with bottom seam exhibiting only a single strip with vertical holding elements, such as needles, are disclosed in DOS 3,211,217, DOS 3,021,868, DOS 3,100,722, DAS 2,141,045, and U.S. Pat. No. 4,261,780.

DOS 3,026,494 discloses a device for stacking and depositing bags with lateral seams; after separating from the tubular film, these bags are individually carried away by the vacuum-exposed arms of a revolving impeller wheel and are deposited into stacks on holding strips arranged to be rotatable in increments in the horizontal feeding plane and exhibiting vertical pegs. The holding strips are additionally designed to be tiltable for delivering the stacks.

This method of lifting off and stacking bags with lateral seams cannot be employed, however, for bags with bottom seams wherein the latter is welded transversely to the feeding direction and wherein the bag opening with the hang-up holes extends, with corresponding feed, likewise transversely to the feeding direction.

Bags having bottom seams show the advantage over bags with lateral seams, however, that they afford, with laid-in lateral pleats, a substantially higher filling volume.

The invention is based on the object of making it possible to deposit and stack bags with bottom seam on holding elements and also transfer to wire bows (wickets) and/or permitting blocking of bags deposited into stacks in this way. The device is to afford a production process for the bags with bottom seam and made of thermoplastic synthetic resin films that can be performed as far as possible without interruption, i.e. without idle cycles, at high production rate.

In order to attain the aforementioned object, a device of the type described herein is fashioned in such a way that the crossbeams are articulated and guided at the periphery of a rotatable support which support, is designed especially in the manner of an impeller, and is arranged vertically with respect to an advancing plane. Consequently, the holding elements retain their vertically oriented position along the revolving route of the crossbeams with the support.

The stacking and conveying unit according to this invention is designed as a revolving pin stacker; the deposited stacks are further transported in increments along a circular route in a vertical plane. Bags with bottom seam in variegated designs can be stacked. The stacks can be loosely deposited or they can be blocked and hung into wickets. The interlocking welding operations and punching of the holes for the wicket hoops can be performed jointly. The holding elements can be designed as pegs for suspending the bags from their hang-up holes, or with needles for penetrating pickup of the bags.

According to a preferred embodiment of this invention, the revolving support is equipped with eight traverses arranged and distributed distributed at uniform spacings over the periphery and exhibits a corresponding number of eight standstill positions during one revolution, these positions being attainable in the stacking cycle stepwise in succession by the individual traverses. In the preferred direction of rotation of the support, the crossbeams can be further moved from the receiving position of the bags into a position lying thereabove at a higher level. For wicket deposition of the bags, a feeding unit for wicket bows is associated with a rest position of a crossbeam following the receiving position.

The revolving support for the crossbeams is designed, for example, so that the crossbeams are distributed over the periphery of the revolving support at mutually identical intervals divisible by their number. The number of crossbeams and the size also depends on the maximally to be deposited bag length; for example, with 600 mm being the maximum bag length, 6 or 8 crossbeams are to be provided. It is also possible to deposit two or more bags in side-by-side relationship in case of a multi-web manufacture. The spacing of the individual crossbeams from one another should correspond to at least about half the maximum bag length. The crossbeams are mounted to lateral impeller bars constituting the revolving support, the end points of these bars forming a polygon corresponding to the number of cross-beams with a corresponding number of rest positions along a revolving route. At least the following working positions are provided along a circulating route in the revolving direction in succession:

(a) Receiving station of the bags directly downstream of the welding unit.
(b) An intermediate holding position.
(c) A wire bow feeding station.
(d) A removal station for the stacks of bags.

Furthermore, the drive mechanism for the revolving support is controllable by a counter, impulse-controlled by the welding station, for a cyclic rotation after reaching the number of bags predetermined for one stack, corresponding to the number of performed welding operations, by an angle corresponding to the mutual spacings of the cross-beams.

For receiving and stacking the bags, the cross-beams are studded with stacking tubes that, in particular, are open on one side, namely customarily, in correspondence with the arrangement of paired hang-up holes, likewise in a paired pattern. The stacking tubes are threaded, for example at predetermined mutual spacings, into threaded bores predrilled into the crossbeams. Depending on the widths of the bags, the film sheet, and the machine, several stacking tube pairs can be located in side-by-side relationship on the crossbeams, for example two pairs in case of a two-panel mode of operation, three pairs with three-web mode of operation, and so forth.

The crossbeams with the holding elements are guided in the lateral impeller bars of the revolving support in such a way that the crossbeams will not twist during their rotation and accordingly, the holding elements, such as stacking tubes, pins, will always remain unchanged in the vertical position.

The diameter of the holding elements, such as stacking tubes, is related to the diameter of the hang-up holes punched into the bags; for example, if the hang-up holes have a diameter of 12 mm, then the stacking tube should exhibit a smaller outer diameter of, for instance, 6–8 mm.

The correct positioning of the stacking tubes at the stacking position of the bags is of importance, i.e. immediately downstream of the welding unit. In this connection, it is to be taken into account that the required distance between the upper hang-up hole rim and the top edge of the bag can be accurately maintained since this feature offers the assurance for a clean tearing off of the bag from the blocked stack during the subsequent filling step. Punching of the hang-up holes including the tear-off perforation slot takes place especially directly upstream of the welding and cutting station so that it is thereby possible to provide assurance for positioning within a minimum tolerance range, i.e. within corresponding to the feeding and cutting length tolerance. The device of this invention is therefore constructed in such a way that the revolving support is associated with the welding and cutting station downstream of the latter, and in a standstill position of the revolving support, serving for bag reception, the top ends of the holding elements of a crossbeam are in each case in alignment with the conveying plane of the film tube and/or lie somewhat below this plane. It is furthermore provided that there are arranged, in the interspace between the welding bar of the welding station, located above the conveying plane transversely thereto and being able to execute a reciprocating motion, and a crossbeam located in the bag receiving position, in direct succession and in parallel to the welding bar, a cutting knife capable of performing a reciprocating motion above the conveying plane, a supporting strip below the conveying plane, and a pressure strip capable of performing a reciprocating motion above the conveying plane. As a result, stacking of the bags onto the holding elements of the crossbeams can be performed directly in conjunction with and/or after the welding and cutting operation. The bags are disposed, after the feed transport is completed, in the zone of the hang-up holes exactly above the stacking tubes and are hammered onto the holding elements simultaneously with or directly subsequently to the cutting step by means of a pressure strip that is activated, for example, pneumatically. This pressure strip can selectively also be equipped with spot welding heads in order to block the bags in the zone of the bag opening or of their top flap into a stack of bags during the stacking operation.

It is important for the cutting step within the welding and cutting unit to also be able to utilize a heatable cutting blade whereby a clean cut as well as a long operating lifetime of the cutting blade become possible.

The welding, cutting and bag stacking system according to this invention almost completely excludes faulty operations during automatic manufacture and consequently offers a very high production safety and economy.

In order to reduce the weight of the stacked bags hanging on the crossbeam and thus simultaneously the localized stress arising at the top edge of the hang-up holes of the bags and to avoid tearing, the crossbeams are equipped with depositing combs serving as depositing support for the bags; these combs, in particular, drop slightly downwardly in an arc in the feeding direction. Thereby, dropping off of the bag bottom, provided with the weld seam, is likewise delayed, and cooling of the weld seam is promoted so that mutual adherence of the weld seams is avoided.

For an improved lateral guidance of the bags during the stacking operation, guide baffles can be mounted to the crossbeams. Between the receiving positions of the individual comb tines of the depositing combs, the cross-beams are provided with slotted recesses on the topside serving for allowing the transfer comb for the stack of bags to dip into while the stack is removed at the discharge station of the revolving support for transfer to packaging.

Figure 2:
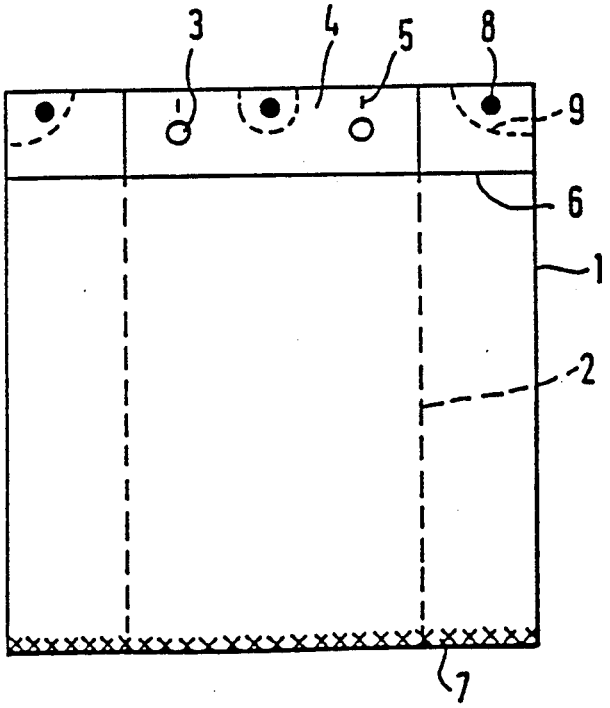
Figure 3:
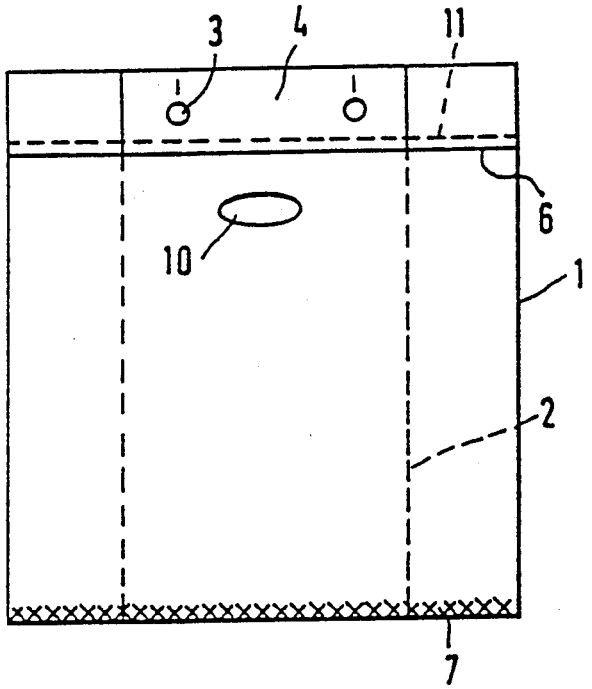
Figure 4:
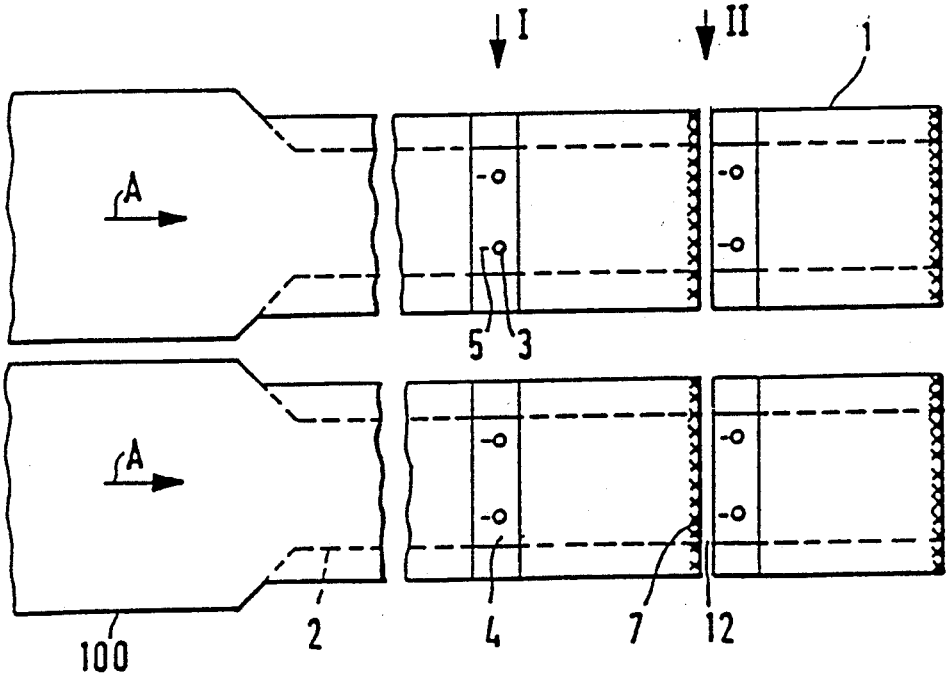
Figure 5:
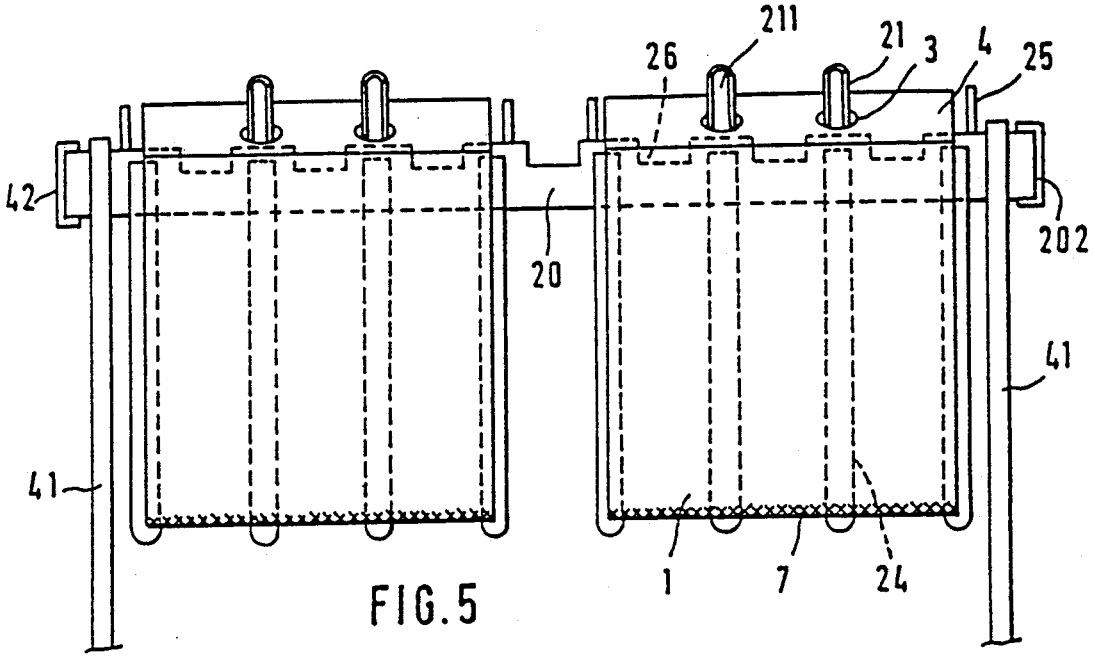
Figure 6:
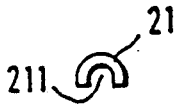
Figure 7:
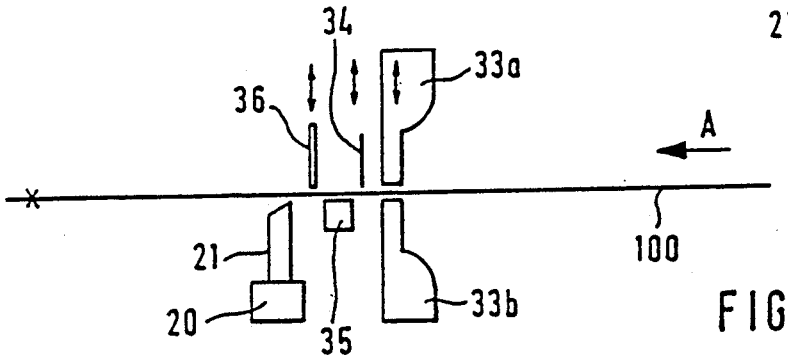
Figure 8:
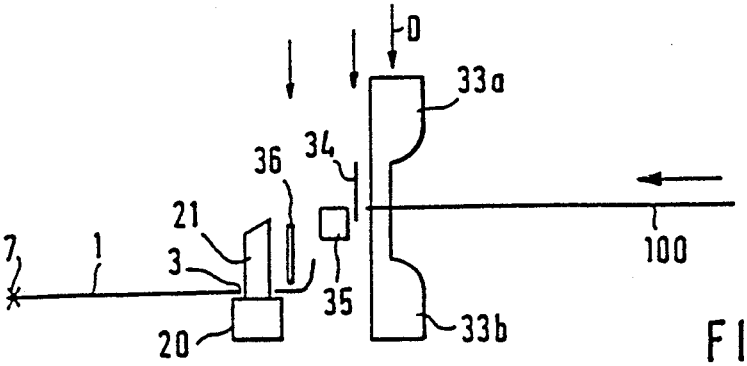
Figure 9:
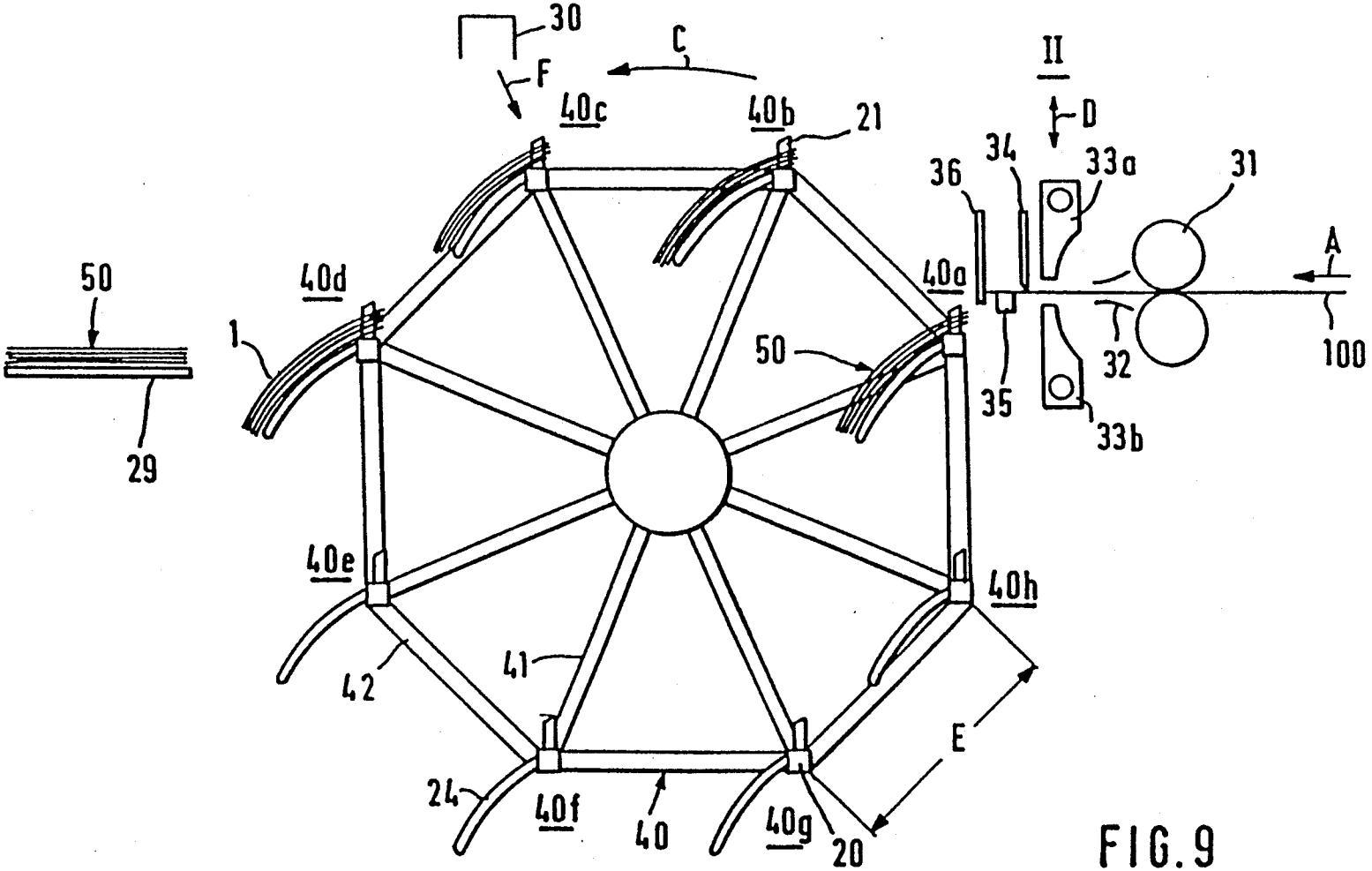

The invention is illustrated by way of example in the drawings wherein:

FIGS. 1, 2 and 3 show three different bags with bottom seam in elevational views, FIG. 4 shows a schematic top view of the production of the bags from a film tube, FIG. 5 shows a schematic front view of a cross-beam with a bag stacked thereon, FIG. 6 is a schematic plan view of a stacking tube, FIGS. 7 and 8 show the welding and severing station with bag transfer to the crossbeam in a schematic illustration during the welding operation, FIG. 9 is a schematic view of the welding and severing station with stacking and conveying unit including revolving support, in a schematic view.

FIGS. 1–3 show examples of bags 1 of thermoplastic synthetic resin film having a bottom weld seam 7 and inserted lateral pleats 2. The bags exhibit, in the region of the bag opening 6, a top flap 4 with two hang-up holes 3 projecting unilaterally at the rear wall; at a small spacing in the direction toward the outer edge of the flap, the tear-off perforation slots 5 are associated with these hang-up holes. These bags, as shown in FIG. 3, can additionally include a punched-out handle hole 10. Moreover, the bags can also exhibit a tear-off perforation line 11 above the bag opening 6, along which the bag 1 can be torn off the top flap 4. The bags can also be blocked together within the stack in the zone of the top flap by means of spot welds 8, as illustrated in FIG. 2. These spot welds can—if necessary—be punched off, for example, along the lines 9 illustrated in dashes. These lines can also be fashioned as a tear-off perforation 9. The bags 1, arranged in superposition in a stack, can be retained in this case on wickets or wire bows passed through the hang-up holes 3. The bottom-seam bags with side pleats and top flap, shown in FIGS. 1–3, can be filled very easily since the front wall is exposed at the bag opening 6 below the hang-up holes 3. It is also possible to form bags with bottom seam without a top flap wherein the hang-up holes 3 pass through both bag walls.

FIG. 4 shows schematically in a top view the formation of the bag 1 according to FIG. 1 in case of two-panel manufacture from a tubular film 100 in the feeding direction A. First of all, the lateral pleats 2 are inserted in the tubular films, then, in a cutting and punching station I, the top flap 4 is produced by cutting out a film strip on the topside, and the hang-up holes 3 and tear-off perforation slots 5 are punched in. Thereafter, the film sheet 100 is further conducted in increments of respectively one bag length through the welding and severing station II, and the bottom weld seam 7 is produced for sealing the end of the film tube, and the severing cut 12 is performed for separating the preceding bag 1. Then, the film tube is further advanced with the bottom seam leading into a position corresponding to the desired bag length, and, in the advanced position, the region with the receiving holes, adjoining the severing cut to be performed, is positioned above correspondingly associated holding elements 21, and then simultaneously with or directly after the performance of the severing step, this region is pressed onto the holding elements. After the number of bags preselected by a counter, stacked onto the holding elements, has been attained, the holding elements are made to travel in stacking rhythm along a circular revolving route beginning in the upward direction. The advancement of the holding elements takes place directly after completion of the depositing and cutting off of the last bag pertaining to a stack, still during the performance of the associated step of welding the bottom seam of the next following bag.

FIGS. 7, 8 and 9 illustrate schematically in detail the station II and the subsequent depositing, stacking, and conveying unit. The film sheet 100, already provided with the top flap 4 as well as the hang-up holes 3 with tear-off perforation slot 5, is advanced in increments in the feeding direction A by means of feed rolls 31 through a comb guide 32 until the set bag length has been reached, in leading mode through the welding unit 33*a*, 33*b*. During this step, the film sheet which is loose after passing the welding unit for the bottom seam toward the bag end is initially supported on the supporting strip 35 arranged on the underside transversely to the feeding direction, see FIG. 7. Then the upper part of the welding unit with welding bar 33*a*, cutting blade 34, and bag take-off strips 36 is lowered. Of these elements, the cutting blade 34 and the bag take-off strip 36 initially contact the film sheet 100 simultaneously, and perform the severing cut and the downward urging of the bag, severed by the cut, along the supporting strip 35 to below and past the latter, see FIG. 8. During this procedure, the bag 1 is deposited with the prepunched hang-up holes 3 on the associated holding elements, e.g. stacking tubes 21, while the bottom seam welding bond 7 is established along the other side of the cutting edge. The holding elements are arranged with their heads directly below the advancement plane, i.e. the welding plane.

The stacking tubes 21 are provided, for example, with a unilateral insert slot 211 for wire bows, see FIG. 6.

The holding elements 21 are attached to cross-beams 20, e.g. round rods or square rails, for example by threading into place. The crossbeams preferably exhibit a plurality of thread-in bores for accommodating the desired number of holding elements for varying spacings. In case of two-panel bag manufacture with respectively two hang-up holes, two pairs of holding elements 21 are provided at a corresponding mutual distance, in side-by-side relationship, as can be seen, for example, from the view of FIG. 5. The traverses 20 are articulated and guided on the periphery of the revolving support 40. The support 40 is designed as an impeller wheel with impeller rods 41 extending radially from the hub and with tangential guides 42 associated with the ends of the impeller rods and guiding the ends 202 of the traverses, see FIGS. 5 and 9. The guides 42 have the effect that, upon rotation of the support 40 in the direction of arrow C, the stacking tubes 21 on the traverses retain their vertical position also during the entire revolution of the traverses with the revolving support 40. In the illustrated example, the revolving support 40 is equipped with eight cross-beams 20 arranged in uniform distribution over the circumference. The revolving support is arranged directly downstream of the welding unit in such a way that, as explained with reference to FIGS. 7 and 8, the automatic stacking of the cut-off bags 1 onto the holding elements 21 of the crossbeams can be carried out.

After reaching the number of bags per stack 50 that has been preselected by way of a counter, not illustrated in detail, on the holding elements of a crossbeam, the revolving support 40 rotates by an angle corresponding to one spacing length E in the direction of arrow C. In case of FIG. 9, the stack 50, deposited in position 40*a*, would be moved with the crossbeam into position 40*b*. The rotational advance takes place directly after completion of the depositing step for the last bag on the holding elements 21 of position 40*a*, i.e. still during the welding procedure. As a result, the subsequent crossbeam, still in position 40*h*, is located poised for the operating position, i.e. it can be moved into position 40*a* and the production process can go on continuously, even before or directly after onset of the next stack transport.

During formation of the next stack of bags in position 40*a*, the stack transported to position 40*b* is in the dwell mode. A feeding unit for wire bows 30 is associated with position 40*c*. Here, wire brackets 30 are automatically fed in direction of arrow F from a magazine arranged above position 40*c*, i.e. introduced from above into the holding elements designed as stacking tubes according to FIG. 6. With the subsequent feed, taking place with a one-eighth revolution of the rotary support 40, the stack of bags, studded with wire bows 30, passes on to position 40*d*. At this location, removal of the stack of bags 1 can take place by robot hand from the unilaterally open stacking tubes, and depositing can proceed into packaging cartons made available here. The schematically indicated robot hand 29 can be fashioned in the form of a transfer comb dipping into the slotted recess 26 of the cross-beam 20, see FIG. 5, by dropping to underneath the stack of bags, and removing the latter by lifting from the stacking tubes.

The empty crossbeams then travel from the removal station 40*d* via the idling stations 40*e*, 40*f*, 40*g* and 40*h* back to the bag depositing station 40*a*. In order to enhance the exact positioning of the deposited bags on the holding elements of the crossbeams, the latter can be provided on the topside with guide baffles 25 which optionally are adjustable in dependence on the width of the bags to be deposited.

It is also possible to design the device in such a way that, simultaneously with pressing the bag onto the holding elements, spot welding is performed in the zone laterally of the hang-up holes of the superimposed bags, each bag which is placed on the stack being welded or stitched onto the stack.

I claim:

1. A device for manufacturing stacks of bags having a bottom weld seal from a tubular film of a thermoplastic synthetic resin by moving the film in an advancing horizontal plane in increments of, respectively, one bag length in a feeding direction, welding the bottom seam transversely to the feeding direction and cutting the film parallel to the bottom seam, thereby separating each bag from the film and depositing each bag to form a stack, said device comprising a welding and cutting means operating in cycles transversely to the feeding direction for welding the bottom seam and for cutting the film to separate each bag from the film and to form a plurality of separate individual bags, a stacking and conveying unit comprising a revolving support arranged to rotate in a vertical plane transversely to the advancing horizontal plane of the film, said support including crossbeams arranged at uniform spaces along a periphery of the support and transversely to the feeding direction, said crossbeams being equipped with vertically upwardly oriented holding elements for receiving the individual bags severed from the film and deposited thereon to hold a stack of bags, said crossbeams being articulated and guided at the periphery of the revolving support so that during rotation of the revolving support, the holding elements each retain a vertical oriented position along a circular route, and said support including drive means operatively associated with the welding and cutting means for effecting a cyclic rotation corresponding to the space between two neighbored crossbeams after a predetermined number of bags are deposited onto the holding elements of a crossbeam to form said stack of bags.

2. A device according to claim 1, wherein the revolving support comprises an impeller-like frame provided with eight crossbeams arranged at uniform spacings over the periphery of the support, said crossbeams exhibiting a corresponding number of eight standstill positions during one revolution of the support, these positions being attainable by stepwise cyclic rotation of the support according to a stacking cycle.

3. A device according to claim 1 or claim 2, wherein the revolving support is arranged for rotation of the crossbeams from a receiving position of the bags in an upward direction to a higher-level position located above the receiving position.

4. A device according to claim 1, wherein the number of crossbeams corresponds to the number of rest positions along the circular route of the periphery of the support, whereby at least along the route in the revolving direction, in succession, the positions correspond to (a) a receiving station of the bags directly downstream of the welding unit;
(b) an intermediate holding station;
(c) a feeding station for wire bows, said feeding station being associated with a feeding unit for wicket bows, and
(d) a removal station for the stacks of bags.

5. A device according to claim 1, wherein the drive means of the revolving support is controllable by a counter, impulse-controlled by the welding and cutting means, for a cyclic rotation after reaching the number of bags predetermined for one stack, in correspondence with the number of welding steps performed, by an angle corresponding to a mutual spacings of the crossbeams.

6. A device according to claim 1, wherein the crossbeams are equipped with depositing combs leading in the feeding direction and oriented slightly obliquely in the downward direction.

7. A device according to claim 6, wherein the crossbeams exhibit a topside slotted recess arranged in axially offset relationship with respect to the depositing combs.

8. A device according to claim 1, wherein upper ends of the holding elements of a crossbeam of the revolving support in a standstill position serving for reception and depositing of bags are in alignment with the advancing plane of the film or lie somewhat below said plane.

9. A device according to claim 1, wherein the welding and cutting means comprises a welding bar located above the advancing plane transversely thereto and being able to execute a reciprocating vertical motion, said welding bar being located with interspace to the crossbeam located in a receiving position for the bags and further comprising a cutting knife capable of performing a reciprocating motion above the advancing plane, a supporting strip below the advancing plane, and a pressure strip capable of performing a reciprocating motion above the advancing plane being arranged in said interspace in direct succession and in parallel to the welding bar.

10. A device according to claim 9, wherein the pressure strip is equipped with spot welding heads.

11. A device according to claim 1, wherein the spacing of the individual crossbeams from one another correspond to at least about half a length of one bag.

12. A device according to claim 1, wherein the holding elements of the crossbeams are in the shape of stacking tubes for the introduction of wire bows.

13. A device according to claim 1, wherein the holding elements of the crossbeams are in the shape of a pin.

14. A device according to claim 1, further comprising means for moving said tubular film within said advancing plane, means for forming hang-up holes along a top portion of each bag having a bottom weld seam and means for depositing the bags successively onto the rotating support so that the holding elements engage with the hang-up holes.

* * * * *